United States Patent [19]

Block et al.

[11] Patent Number: 4,686,419

[45] Date of Patent: Aug. 11, 1987

[54] COMPACT HIGH-PRESSURE DISCHARGE LAMP WITH A FILL INCLUDING CADMIUM AND LITHIUM HALIDE

[75] Inventors: Werner Block, Taufkirchen; Wolfgang Pabst; Manfred Pilsak, both of Munich, all of Fed. Rep. of Germany

[73] Assignee: Patent Treuhand Gesellschaft fur elektrische Gluhlampen mbH, Munich, Fed. Rep. of Germany

[21] Appl. No.: 829,413

[22] Filed: Feb. 13, 1986

[30] Foreign Application Priority Data

Feb. 22, 1985 [DE] Fed. Rep. of Germany ..... 3506295

[51] Int. Cl.[4] ..... H01J 61/20; H01J 61/38

[52] U.S. Cl. ..... 313/641; 313/639; 313/640

[58] Field of Search ..... 313/640, 641, 571, 638, 313/490, 564, 642, 643

[56] References Cited

U.S. PATENT DOCUMENTS

| | | | |
|---|---|---|---|
| 3,654,506 | 4/1972 | Kuhl et al. | 313/184 |
| 4,138,621 | 2/1979 | Downing et al. | 313/113 |
| 4,243,906 | 1/1981 | Wilson | 313/640 X |
| 4,290,097 | 9/1981 | Block et al. | 362/264 |

FOREIGN PATENT DOCUMENTS

| | | | |
|---|---|---|---|
| 2422411 | 12/1975 | Fed. Rep. of Germany | 313/641 |
| 7011321 | 2/1972 | Netherlands . | |
| 1376509 | 12/1974 | United Kingdom . | |

OTHER PUBLICATIONS

Lamps and Lighting, Third Edition, M. A. Cayless and A. M. Marsden.

*Primary Examiner*—Palmer C. DeMeo
*Assistant Examiner*—K. Wieder
*Attorney, Agent, or Firm*—Frishauf, Holtz, Goodman & Woodward

[57] ABSTRACT

A metal halide high-pressure discharge lamp has a discharge vessel of compact construction, with a fill of mercury, at least one noble gas, typically argon, and a metal halide, with an excess of halogen. The halogen component of the metal halide is formed by iodine and/or bromine. An average light density in excess of 30 ksb, with a specific arc power of between 400 to 5000 W/cm is obtained over an average lifetime of 250 hours with a color rendering index Ra of at least 85 by utilizing cadmium and lithium as the metal component in the metal halide of the fill. Preferably, holmium also is used as a metal for the metal halide, the fill including between 0.1 and 5 mg cadmium, up to 0.05 mg lithium, and 0.05 to 1 mg holmium in a preferred form, halogen and bromine being present in a mol relation of between 0.5 to 2 within the discharge vessel. The excess halogen may be up to about 35 micromol per cubic centimeter of volume of the discharge vessel. The lamp is particularly suitable for optical projection systems, for example for combination with a reflector (13).

12 Claims, 3 Drawing Figures

COMPACT HIGH-PRESSURE DISCHARGE LAMP WITH A FILL INCLUDING CADMIUM AND LITHIUM HALIDE

The following are related patents, the disclosure of which is hereby incorporated by reference: U.S. Pat. No. 3,654,506, KUHL and DOBRUSSKIN assigned to the assignee of the present application; U.S. Pat. No. 4,138,621, DOWNING et al; and German Pat. No. 21 14 804, corresponding to British No. 1 376 509.

The present invention relates to a high-pressure discharge lamp, and more particularly to a high-pressure discharge lamp, which is compact in dimensions and capable of accepting a wall loading in excess of 100 W/cm$^2$, and especially adapted for use with optical systems, for example projection systems or the like.

BACKGROUND

High-pressure discharge lamps usually include a discharge vessel made of high-temperature resistant light-pervious material, such as quartz glass or very hard glass, forming a single discharge vessel or bulb. Two electrodes of high-temperature resistant material are melt-sealed into the discharge vessel. The discharge vessel retains a fill which includes mercury and noble gas and metal halides, as well as iodine and/or bromine, forming an excess halogen within the discharge vessel.

U.S. Pat. No. 4,138,621, Downing and Sobieski, describes a short arc discharge lamp adapted for direct current operation for use with a short arc, operated within a single uncovered discharge vessel or bulb open to the atmosphere. The bulb retains an ionizable fill including an inert gas such as argon, halogen, and a metal halide, for example indium idiode. The discharge lamp has a high average light density. The lifetime of the lamp, however, unfortunately is limited, being on the average less than 100 hours, and the color stability of the radiation emitted from the lamp is insufficient for optical projection use. The density of emitted light decreases as the lamp is used, apparently due to substantial erosion of the tip of the cathode, due to the d–c operation of the lamp.

Mercury vapor high-pressure discharge lamps of the type described, for example, in the referenced U.S. Pat. No. 3,654,506, KUHL and DOBRUSSKIN, and German Pat. No. 21 14 804, utilize an additive of rare-earth halides to the fill. Dysprosiuim and/or holmium and/or thulium are suitable rare-earth halide additives. The laps have a light emission of 90 lumens per watt (1 m/W) or more; the color temperature of the radiation is 6000° K., with a color rendering index Ra of 92. These lamps are not suitable for projection use or for combination with other optical systems which require high light density, since the lamps are comparatively large, that is, they are not compact with a comparatively short arc. If the lamp is reduced in size, so that the dimensions would be suitable for projection use, the discharge arc will have a core which has a color rendition index substantially below 92 and a color temperature exceeding 6000° K., this core being the only light used for illumination of a projection window, for example.

THE INVENTION

It is an object to obtain a compact high-pressure discharge lamp generally known as a short-arc lamp, suitable for alternating current (a–c) operation, which provides radiation with a high average light density and excellent color index and color rendition and which, further, has a long average lifetime, that is, in general, a compact high-pressure discharge lamp suitable for combination with an optical system, such as a system to illuminate a projection window of a motion-picture projector, a slide projector, or a light beam projector of any kind.

Briefly, the fill includes, as primary metals for the metal halides, cadmium and lithium and, possibly, holmium. The lamp with a fill which includes these materials has an average light density which is larger than 30 ksb, a specific arc power of between 400 to 5000 W/cm and an average lifetime of 250 hours. The color rendition index Ra is at least 85.

Average lamp life is defined as the time during which the light emitted from the lamp, without any optical systems, decreases by at most 15%. This insures that the decrease in emitted light in a suitable optical system, after the "average lifetime" has elapsed, is in the region of 20% and not more than 45%.

It has been found that the use of cadmium and lithium as the metals in the metal halides will result in a lamp having a discharge arc of high color quality, in which the entire arc, including the edge of the radiation, has excellent color rendition, that is, a color index Ra of at least 85. This insures that the radiation of the core of the arc, which is the light utilized for projection purposes, has good color rendition, that is, the projected image will appear natural. The color rendition index Ra of the core will then fall between 70 and 80, and possibly be higher. The element lithium is used to fill in the spectrum in the longer wavelength range, that is, in the red portion of the visible spectrum.

In accordance with a preferred feature of the invention, the discharge vessel includes further a halide of holmium as a metal halide. Due to the large number of spectral lines of radiation received from holmium, the color index is further improved, so that the lamp will be suitable for use in projection systems for illumination in studios used for filming of scenes by motion-picture film and for similar scene illumination.

Light density, color rendition, and lifetime are optimized when the discharge vessel has a fill as follows: for each cubic centimeter of volume of the discharge vessel:

between 0.1 and 5 mg cadmium, up to 0.05 mg lithium, and between 0.05 and 1 mg holmium for the respective metal halides. If the metal halides are present in larger quantities, absorption effects will be observed which result in a decrease of emitted light. The color temperature of the lamp can be varied by means of the lithium, and, depending on the utilization, the color rendition of light in the red wavelength region can be controlled thereby.

The halogen cycle is maintained and the optimum vapor pressure adjusted by providing bromium and iodine within the discharge vessel in a mol-proportion of between 0.5 and 2. For each cubic centimeter of internal volume of the discharge vessel, an excess of up to 35 micromol of halogen is present, with respect to stoichiometric relationship of the halogen and metal compounds. If the halogen cycle does not operate properly, the discharge vessel will blacken more than desirable, due to excess tungsten deposition from the electrodes. This reduces the average lifetime of the lamp—lifetime being defined, as above, with relation to light emission. The best results with respect to lifetime and light density are obtained at a mol proportion of 1:1 of bromine and iodine.

As basic gas, the lamp fill includes only argon, which, in a cold lamp, is present at a pressure between $10^4$ and $10^5$ Pa. This insures reliable handling of the high-pressure discharge lamp when cold. The pressure, however, is still so high that, upon ignition of the lamp, erosion due to vaporization of the tungsten electrodes, and thus blackening of the discharge vessel, is effectively prevented.

The arc is stabilized by including cesium within the discharge vessel.

Preferably, the compact high-pressure discharge lamp is used with a reflector which is securely connected to the lamp, in an overall projection system. It is, however, also possible to make the lamp independently of a reflector and use the lamp for special illumination systems, for example for searchlights and projections systems in which the light is tightly bundled and maintained in a tight light beam, used, for example, for scene illumination in film studios, theatrical illumination and the like.

DRAWINGS

DETAILED DESCRIPTION

Figure 1:
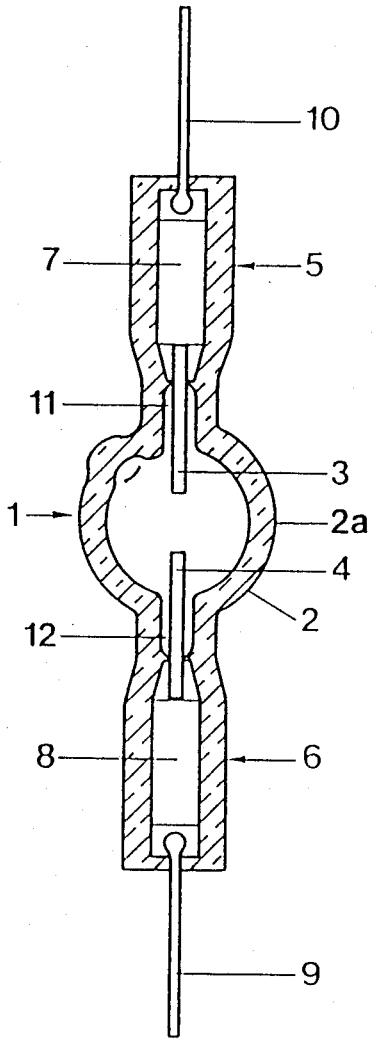
FIG. 1 is a sectionalized side view of the high-pressure discharge lamp in accordance with the invention.

The lamp of FIG. 1 illustrates a 400 W high-pressure discharge lamp 1, having rod-like electrodes 3, 4 fitted within a discharge vessel formed as a bulb 2, and made of quartz glass. The electrodes 3, 4 are retained in bulb extensions, which are shaft-like or rod-like, illustrated at 5 and 6 in FIG. 1, and made of the same material and formed as extensions of the vessel or bulb 2. The electrodes 3, are electrically connected by molybdenum foils 7, 8, vacuum-tightly sealed by melt press seals into the bulb shafts 5, 6. Short extension or free spaces 11, 12 are provided at the junction of the electrodes 3, 4 to the shaft ends 5, 6 of the lamp to provide space for deposition of tungsten eroded from the electrodes 3, 4 during operation, as well as for contaminants which may condense, and collect from the interior of the lamp. These deposition spaces 11, 12 prevent blackening of the bulb portion 2*a* of the vessel 2, which is the essential light emitting portion of the vessel 2. The molybdenum foils 7, 8 are connected to lamp terminal elements 9, 10.

Lamp data

The lamp of FIG. 1 is a 400 W high-pressure discharge lamp, for use in a reflector system (not shown):
Length: about 5.6 cm
wall thickness of the quartz glass of discharge vessel 2: 0.22 cm
interior volume of vessel 2: 0.76 $cm^3$
distance between ends of electrodes 3, 4: 0.42 cm
length of vessel shafts 5, 6: about 2 cm
vessel shafts 5, 6 have circular cross section of about 0.8 cm outer diameter
fill:
- 0.15 mg holmium
- 0.18 mg CsBr
- 0.10 mg CsJ
- 0.10 mg LiBr
- 0.07 mg LiJ
- 1.80 mg $CdJ_2$
- 2.00 mg $HgBr_2$
- 0.60 mg $HgJ_2$
- 13.1 mg metallic mercury argon at a basic gas pressure of 66.6 kPa.

Operating data

Lamp voltage: 55 V, and lamp current of 7.3 A initial light output: 30 klm, color temperature: 4500° K.

In a projection system without rotary shutter, and having a 16 mm image window with a 1.2/50 mm lens, 3600 lumens may be obtained at a screen, in which the uniformity of illumination, formed by the ratio of $E_{min}/E_{average}$, in accordance with German Industrial Standard DIN 15748, is 0.65 and higher.

Figure 2:
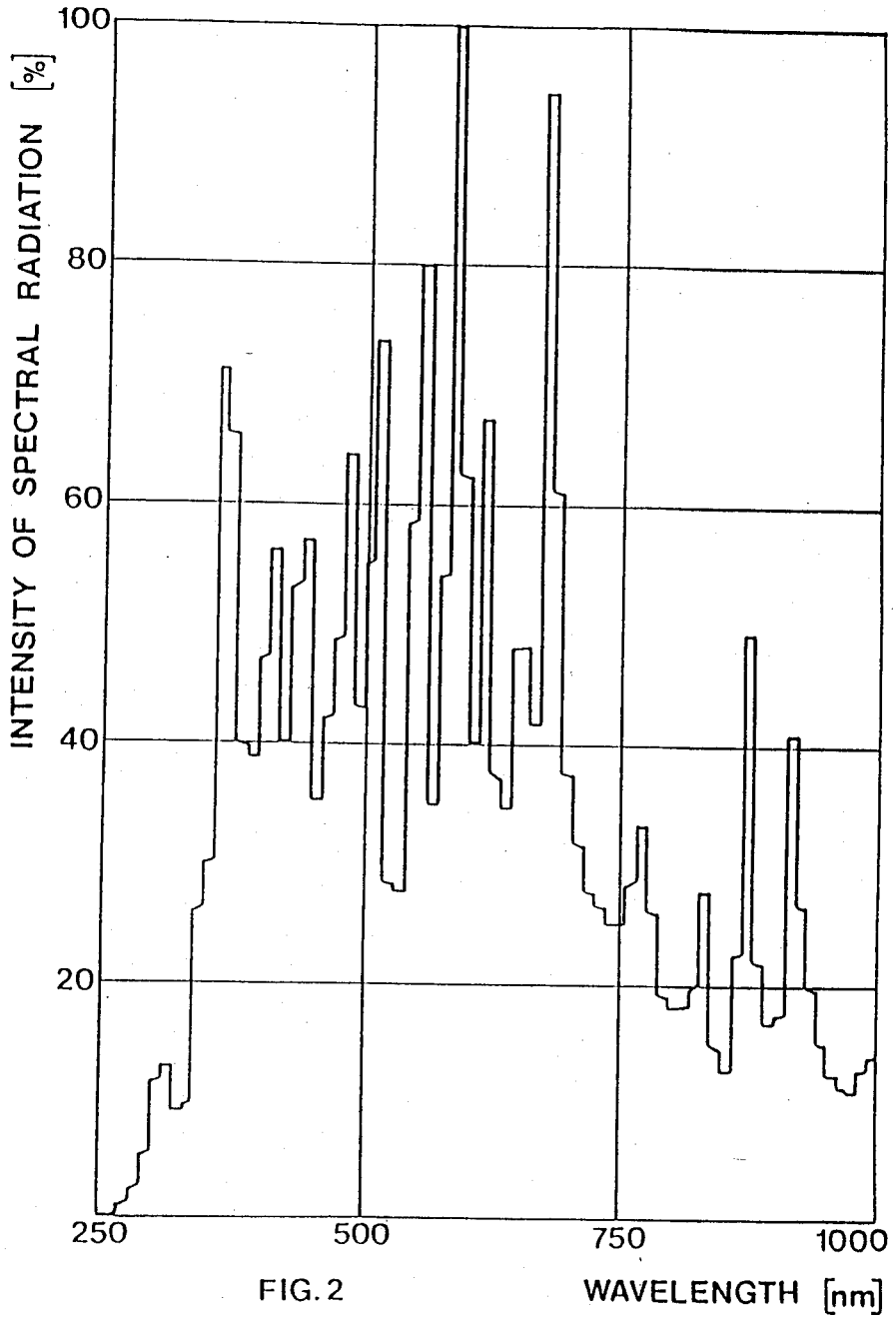
FIG. 2 is a graph illustrating spectral distribution of the light emitted by the lamp of FIG. 1.

FIG. 2 illustrates the spectral distribution of the lamp of FIG. 1 with respect to wavelength, in the region between 250 and 1000 nm wavelength. 100% intensity is related to 0.69 W per sr and 10 nm.

Figure 3:
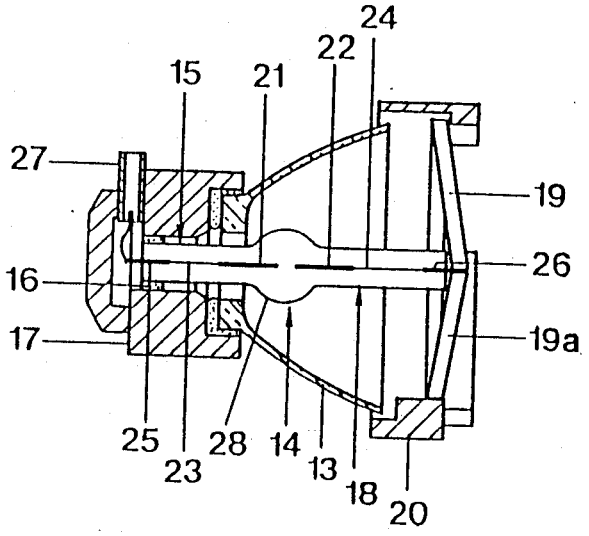
FIG. 3 is a sectional view of the lamp in combination with a reflector.

Embodiment of FIG. 3

A lamp 14 is securely connected and assembled with a reflector 13. The lamp has a power rating of 270 W. The lamp 14 is coaxial with the axis of the reflector 13. An electrode shaft 15 is secured by a suitable cement 16 within a ceramic base 17. The other electrode shaft 18 is retained at the edge of the reflector 13 by a pair of copper strips 19, 19*a*, fitted into a ceramic terminal ring 20. A suitable electrical connection is made to the copper strips 19, 19*a* to provide a terminal for current supply. The electrodes 21, 22 are connected to the lamp terminals by molybdenum foils 23, 24 melt-sealed into the lamp shafts, and connected to electrical terminals 25, 26. One electrical connection 27 is secured to the base 17, the other, not visible in the drawing, is fitted into the ring 20 and electrically connected to the copper strips 19, 19*a*.

Lamp data

The lamp 14 has a power rating of 270 W.
length of lamp 14: about 4.8 cm.
Volume of discharge vessel, typically of quartz glass: 0.28 $cm^3$.
Electrode spacing of electrodes 21, 22: 0.25 cm.
Reflector 13: mirrored ceramic or glass.
Fill of discharge vessel 28:
- 0.05 mg Ho
- 0.13 mg CsBr
- 0.07 mg CsJ
- 0.04 mg LiBr
- 0.03 mg LiJ
- 1.10 mg $CdJ_2$
- 1.18 mg $HgBr_2$
- 0.25 mg $HgJ_2$ as well as
- 7.5 mg metallic mercury argon, with a basic gas pressure (cold lamp) of 66.6 kPa.

Lamp operating data

Lamp voltage 45 V at 6 A.
Initial light emission: 18 klm, at color temperature of 4500° K. to 5000° K.

The light emission, that is, the usable light flux of the high-pressure discharge lamp, can be enhanced by operating the high pressure discharge lamp with essentially square-wave supply at about 300 Hz. Operation with such a supply further insures that no flicker will result if the lamp is used in recording or projection systems having rotary shutters. The lamp may, of course, also be used with alternating current of other wave shapes and frequencies, such as ordinary power line supply at 60 Hz.

As used herein
ksb means: kilostilb
sr means: steradian.

What is claimed is:

1. A compact high-pressure discharge lamp (1, 14), particularly for illumination within an optical system, having a single, uncovered bulb comprising a discharge vessel (2, 28) of high-temperature resistant optically transparent material and forming a single arc retention vessel;

two electrodes (3, 4; 21, 22) of high-temperature resistant material leaving a short arc-gap therebetween to define, with the single bulb, a short-arc lamp; and a fill within the vessel comprising the fill components of: mercury, at least one noble gas, a mercury halide, and an excess of halogen, wherein the halogen consists of at least one of: iodine, bromine, and comprising, means for obtaining an average illumination density in excess of 30 ksb with a specific arc power between about 400–5000 W/cm, with a color rendition index Ra of at least 85 over an average lifetime of the lamp of 250 hours which is characterized by the fill further comprising metal halide components in which the metal of the metal halide components is primarily cadmium and lithium.

2. Lamp according to claim 1, wherein the discharge vessel (2, 28) has a fill for each cubic centimeter of its volume of between 0.1 and 5 mg cadmium and up to 0.05 mg lithium of the cadmium and lithium halide, respectively.

3. Lamp according to claim 1, wherein the halogens bromine and iodine are present in a mol relationship of between 0.5 to 2 within the discharge vessel (2, 28).

4. Lamp according to claim 1, wherein the discharge vessel (2, 28), for each cubic centimeter of its volume, has an excess of up to 35 micromol over stoichiometric relationship of the halogen and metal compounds forming the fill within the discharge vessel of the lamp (1, 14).

5. Lamp according to claim 1, wherein the noble gas forming the fill of the lamp (1, 14) consists of argon only, which is present at a pressure of between $10^4$ and $10^5$ Pa, when the lamp is cold.

6. The combination of the lamp
as claimed in claim 1
with a reflector (13), wherein the lamp and the reflector are combined to form a single, essentially inseparable assembly;

and the arc retention vessel or bulb is located in light emitting relationship with respect to a light reflecting surface of the reflector (13).

7. A compact high-pressure discharge lamp (1, 14), particularly for illumination within an optical system, having a single, uncovered bulb comprising a discharge vessel (2, 28) of high-temperature resistant optically transparent material and forming a single arc retention vessel;

two electrodes (3, 4; 21, 22) of high-temperature resistant material leaving a short arc-gap therebetween to define, with the single bulb, a short-arc lamp; and a fill within the vessel comprising the fill components of: mercury, at least one noble gas, a mercury halide, and an excess of halogen, wherein the halogen consists of at least one of: iodine, bromine, and comprising means for obtaining an average illumination density in excess of 30 ksb with a specific arc power between about 400–5000 W/cm, with a color rendition index Ra of at least 85 over an average lifetime of the lamp of 250 hours which is characterized by the fill further comprising metal halide components in which the metal of the metal halide components is primarily cadmium, lithium and holmium.

8. The lamp of claim 7 wherein the discharge vessel (2, 28) has a fill for each cubic centimeter of its volume of between 0.1 and 5 mg cadmium;
up to 0.05 mg lithium; and
between 0.05 and 1mg holmium.

9. The lamp of claim 7, wherein the halogens bromine and iodine are present in a mol relationshp of between 0.5 to 2 within the discharge vessel (2, 28).

10. The lamp of claim 7, wherein the discharge vessel (2, 28), for each cubic centimeter of its volume, has an excess of up to 35 micromol over stoichiometric relationship of the halogen and metal compounds forming the fill within the discharge vessel of the lamp (1, 14).

11. The lamp of claim 7, wherein the noble gas forming the fill of the lamp (1, 14) consists of argon only, which is present at a pressure of between $10^4$ and $10^5$ Pa, when the lamp is cold.

12. The combination of the lamp
as claimed in claim 7
with a reflector (13), wherein the lamp and the reflector are combined to form a single, essentially inseparable assembly;

and the arc retention vessel or bulb is located in light emitting relationship with respect to a ligh reflecting surface of the reflector (13).

* * * * *